United States Patent [19]

McGuire et al.

[11] Patent Number: 4,778,100

[45] Date of Patent: Oct. 18, 1988

[54] DIRECT-MAIL ADVERTISING PACKAGE WITH ACCEPTANCE FORM AND RETURN MAILER ENVELOPE

[75] Inventors: Thomas L. McGuire; Robert M. Steinberg, both of Carmel Valley, Calif.

[73] Assignee: Instant Web, Inc., Chanhassen, Minn.

[21] Appl. No.: 905,349

[22] Filed: Sep. 10, 1986

[51] Int. Cl.[4] ..... B65D 27/06

[52] U.S. Cl. ..... 279/73

[58] Field of Search ..... 229/73, 69, 70, 71

[56] References Cited

U.S. PATENT DOCUMENTS

| | | | |
|---|---|---|---|
| 263,347 | 8/1882 | Mead | 229/92.8 |
| 632,788 | 9/1899 | Philipp | 229/92.8 |
| 695,617 | 3/1902 | Lyne | 229/92.8 |
| 725,963 | 4/1903 | Hoffmann | 229/68 R |
| 879,802 | 2/1908 | Taylor | 229/92.8 |
| 2,045,944 | 6/1936 | Domke | 229/68 R |
| 2,243,974 | 6/1941 | Mitchell | 229/92.8 |
| 2,805,816 | 9/1957 | Morgan | 229/92.8 |
| 3,428,237 | 2/1969 | Dowen | 229/73 |
| 3,507,519 | 4/1970 | McNabb | 229/73 |
| 3,858,792 | 1/1975 | Volkert | 229/73 |
| 3,981,435 | 9/1976 | Johnsen | 229/73 |
| 4,081,127 | 3/1978 | Steidinger | 229/73 |
| 4,148,430 | 4/1979 | Drake | 229/73 |
| 4,351,474 | 9/1982 | Kaelblein et al. | 229/70 |
| 4,380,315 | 4/1983 | Steidinger | 229/69 |
| 4,524,903 | 6/1985 | Vath | 229/73 |
| 4,589,590 | 5/1986 | McGuire et al. | 229/92.8 |

*Primary Examiner*—Willis Little

*Attorney, Agent, or Firm*—Schroeder & Siegfried

[57] ABSTRACT

A direct-mail advertising package includes an acceptance form and a return mailer envelope. The acceptance form and envelope are disposed between a front and back cover, each of which may bear a promotional message. The respective peripheral edges of the package (or other peripherally-disposed portions of the package) are glued together, preferably intermittently, so that the integrity of the package may be maintained during mailing. The front and back covers are integrally joined to form a spine alongside an edge of the package, and recessed index tabs are formed on the package opposite to the spine, so that the package may be "popped" open against its adhesive retention.

The acceptance form is perforated, and when torn away from the package, has outer dimensions which are less than the corresponding inside dimensions of the envelope; thus the acceptance form may be slipped easily into the envelope without folding the acceptance form. If desired, the acceptance form is made from a relatively-thin paper stock. With this arrangement, the acceptance form may be passed through an optical reader without jamming the equipment.

Alternate embodiments are illustrated, including a double fold-out promotional sheet included in the mailing package.

12 Claims, 4 Drawing Sheets

DIRECT-MAIL ADVERTISING PACKAGE WITH ACCEPTANCE FORM AND RETURN MAILER ENVELOPE

FIELD OF THE INVENTION

The present invention relates to a direct-mail advertising package, and more particularly, to a package that retains its integrity during mailing, but which may be easily "popped" open by the addressee to facilitate the separation and selection of an acceptance form together with a return mailer envelope. With this arrangement, confidentiality is assured and yet the need for a large mailing envelope to the addressee is completely eliminated.

BACKGROUND OF THE INVENTION

In our original U.S. Pat. No. 4,589,590 issued on May 20, 1986, there is disclosed and claimed an integral mailing package intended for a variety of purposes, including the use of a return mailer envelope. While not confined thereto, the integral mailing package of our original '590 patent was generally intended for a variety of respective advertisers or purposes. The present invention constitutes an improvement thereon, is adaptable for either for a variety of advertisers or for a specific advertiser, and is especially intended to substantially improve the response rate.

In direct-mail advertising, the mailings usually involve relatively large outer envelopes with various "stuffers". These are commonly referred to as "junk mail". The envelopes provide little external surface for a quality message, and there is no effective space inside of the envelope. As a result, there is a strong tendency for the addressee to merely rip up or toss away the entire envelope without even opening the envelope, much less reading the contents thereof. The recipients may even tend to become irritated, and this is totally counter-productive.

The response rate for a typical mailer is fewer than 5%, and thus direct-mail advertisers have resorted to an assortment of "gimmicks" to improve readability and hence the response rate, recognizing how important it is to get people to just open the envelope. Some advertisers simulate United States Government mailings, as for example the Internal Revenue Service, to get the attention of the recipient. Others mimic private express courier services. Still others use a "blind" envelope bearing only the recipient's address. The use of first class postage envelopes in bold colors such as yellow, and tilted bulk-rate indicia have also been resorted to in an attempt to get the recipient's attention.

In many instances, the mailer includes an acceptance form or card provided along with a return mailer envelope. These mailers may be employed, for example, in the ordering of merchandise from an advertiser, or accepting the solicitation of a credit card from a financial institution. The acceptance form and envelope are usually stuffed inside of a large envelope along with a plurality of advertising sheets or promotional literature. The separate acceptance form and envelope, rather than a return post card, assures the security of the transaction from the customer's standpoint, since the customer's signature and sometimes the customer's credit card number are required. Unfortunately, however, these particular mailers still suffer from the relatively-poor response rate.

Others in the industry have resorted to the use of a return-mailer envelope having a tear-off tab along an edge thereof, wherein the envelope itself constitutes the original mailer and includes the acceptance form and promotional literature. The intent is to create an irresistible urge for the recipient to experience a sense of power or joy in opening the envelope.

All of these prior art methods still require the use of an external envelope, hence have met with only a modicum of commercial success.

These prior art devices are wasteful of advertising dollars and contribute to the relatively low response rate for direct-mail solicitations. Direct-mail advertising is a fast-growing multi-billion dollar a year business in the United States alone, and any improvement in the return rate will have a significant impact on the sales volume and profits of the advertisers.

SUMMARY OF THE INVENTION

Accordingly, it is an object of the present invention to alleviate the disadvantages and deficiencies of the prior art by providing a single-purpose direct-mail advertising package which includes an easily accessible acceptance form and a postage-prepaid return mailer envelope.

It is another object of the present invention to eliminate the necessity for an external envelope to deliver the "package" and its advertising message to the recipient, thereby providing a very desirable promotional feature in the marketing of printing services to direct-mail advertisers.

It is yet another object of the present invention to provide such a direct-mail advertising package that is attractive and has a quality image, arouses the interest and curiosity of the recipient, and induces the recipient to open the package, thereby facilitating a substantial increase in the response rate to the advertiser.

It is a still another object of the present invention to provide such a direct-mail advertising package that is lightweight, yet durable, and maintains its integrity during the mailing process.

It is a further object of the present invention to provide such a direct-mail advertising package that has a good heft and "feel", yet may be easily "popped" open by the addressee to gain access to the contents thereof.

In accordance with the teachings of the present invention, there is herein illustrated and described a preferred embodiment thereof, constituting a direct-mail advertising package. The package includes a plurality of sheets having respective peripheral portions. An adhesive means is provided for binding together at least some of the sheets substantially at their peripheral portions, thereby maintaining the integrity of the package during mailing. The plurality of sheets includes a front cover, a back cover and an acceptance form. A return mailer envelope is disposed between the front and back covers. The front cover bears a display, and the acceptance form bears an addressee thereon. The package has an edge provided with a recessed indexing means, such that the package may be "popped" open to facilitate a manual separation of at least some of the sheets and a selection of the return mailer envelope against the retention of the adhesive means. The acceptance form is perforated for tearing the acceptance form away from the package. The acceptance form, upon removal from the package, has outer dimensions which are less than the corresponding inner dimensions of the return mailer envelope, such that the acceptance form may be received within the envelope without folding the acceptance form.

Preferably, the front and back covers are integrally formed and are joined together to form a spine opposite to the indexing means. In the preferred embodiment, the indexing means constitutes recessed indexing tabs on a lower right-hand corner of the package. If desired, however, the indexing tabs may be placed substantially at the midpoint of any of the three peripheral edges other than the spine.

Preferably, the acceptance form is disposed beneath the front cover; and the front cover has a window formed therein, such that the addressee on the acceptance form is visible through the window. Additionally, the acceptance form has mutually-perpendicular respective perforations formed thereon.

In yet another aspect, the present invention constitutes a direct-mail advertising package including a front cover and a back cover integrally joined together to form a spine along a side edge of the package. A return mailer envelope and an acceptance form are disposed between the front and back covers. An adhesive means is provided for binding at least the front and back covers together (substantially at their respective peripheral edges) to thereby maintain the integrity of the package during mailing. A recessed indexing means is provided, substantially opposite to the spine, such that the package may be "popped" open against the adhesive means to facilitate a selection of the return mailer envelope and acceptance form.

Preferably, the acceptance form has mutually-perpendicular perforations formed thereon, such that the acceptance form may be torn away from the package, and such that when removed the acceptance form has outer dimensions which are less than the corresponding inner dimensions of the return-mailer envelope. As a result, the acceptance form may be received within the envelope without folding the acceptance form. Additionally, the acceptance form is made from a relatively-thin paper stock, whereby the acceptance form may be passed through an optical reader without jamming the reader or distorting the card.

In accordance with a further embodiment, a double fold-out promotional sheet is disposed between the front and back covers.

In yet still another aspect, the present invention constitutes a direct-mail advertising package including a front cover and a back cover integrally joined together to form a spine along a side edge of the package. The package further includes three outer peripheral edges thereon. A double fold-out promotional sheet is disposed between the front and back covers. An adhesive means is provided for binding at least the front and back covers together substantially at the peripheral portions thereof to thereby maintain the integrity of the package during mailing. A recessed indexing means is provided on one of the three peripheral edges of the package, such that the package may be "popped" open against the adhesive means to facilitate a selection and opening up of the double fold-out promotional sheet.

These and other objects of the present invention will become apparent from a reading of the following specification, taken in conjunction with the enclosed drawings.

GENERAL DESCRIPTION OF THE PREFERRED EMBODIMENT

Figure 1:
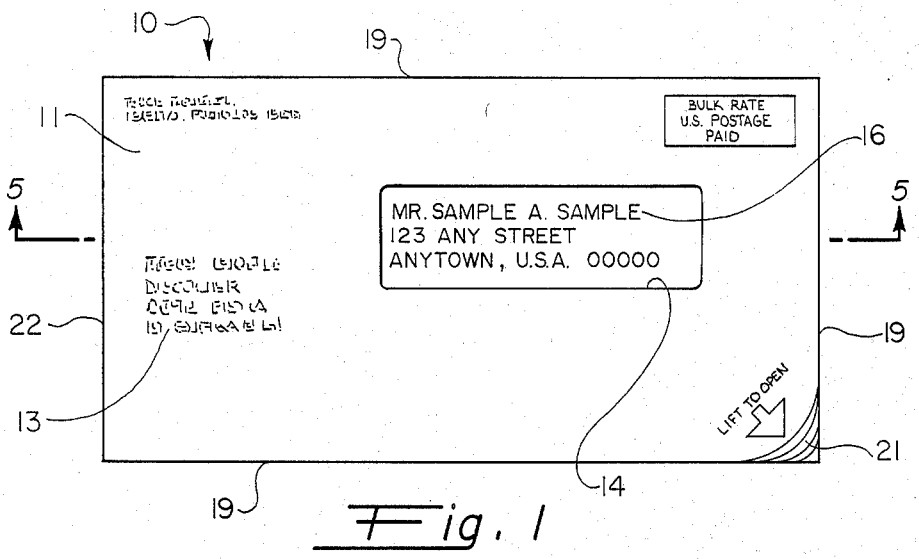
FIG. 1 is a top plan view of the direct-mail advertising package of the present invention.

With reference to FIG. 1–7 of the drawings, a direct-mail advertising package 10 is intended for a specific purpose, such as the solicitation of a potential credit card customer. The package 10 includes a front cover 11 and a back cover 12. The front cover has a display 13 thereon intended to arouse the interest and curiosity of the potential customer. The back cover may also carry a suitable display (not shown herein). Preferably, but not necessarily, the front cover is provided with a window 14.

Figure 2:
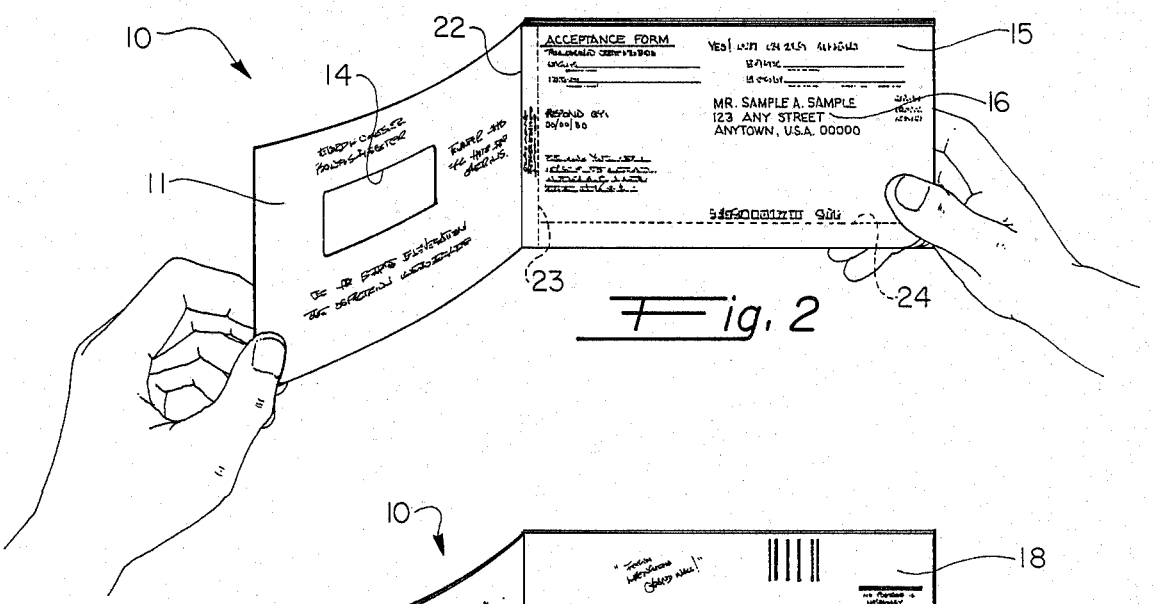
FIG. 2 is a perspective view of the package, showing the front cover being lifted away from the package, and further showing the acceptance form disposed directly beneath the front cover.
Figure 3:
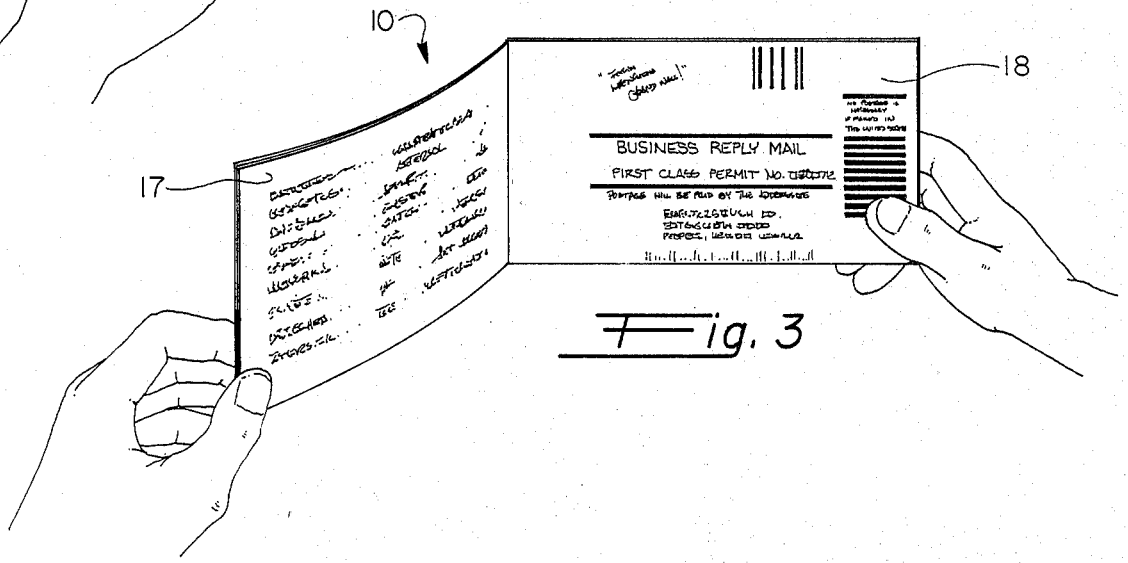
FIG. 3 is a further perspective view of the package, showing the selection of the return mailer envelope.
Figure 4:
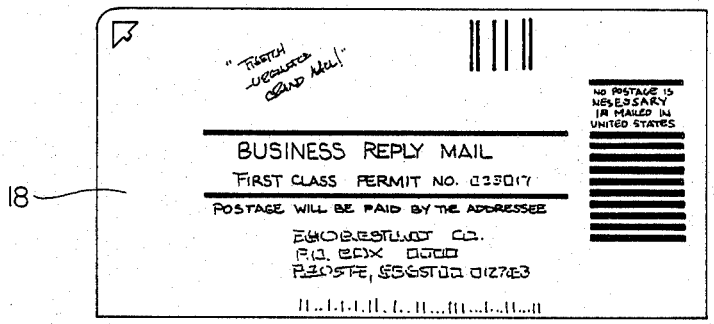
FIG. 4 is a top plan view of the return mailer envelope, showing the address of the advertiser.

An acceptance form 15 is disposed directly beneath the front cover, as shown more clearly in FIG. 2, and bears the addressee's (potential customer's) name and address 16, which (preferably) are visible through the window in the front cover. Optionally, the window may be eliminated, and the acceptance form may be personalized in such a manner that the address matches with the address on the front cover.

Figure 5:
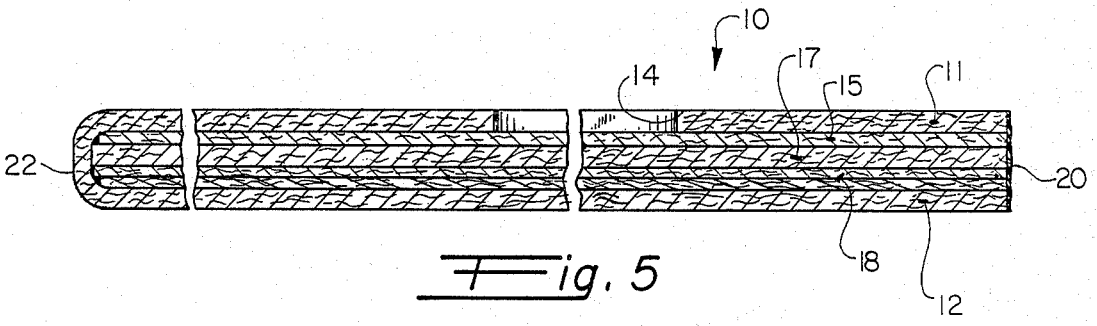
FIG. 5 is a section view, taken along the lines 5—5 of FIG. 1, drawn to an enlarged scale, and showing the plurality of sheets or items constituting the overall package.

The front and back covers may be formed from a single sheet which is folded in half to form a "spine" along the left-hand side edge of the package (as hereinafter described) such that the contents of the package may be inserted between the front and back covers, or separate sheets may be laminated together if necessary. The package also includes one (or more) sheets, such as sheet 17 as shown in FIG. 5, bearing a promotional message on both sides thereof. Of further significance, the inside portion of the front and back covers may also be used effectively for important promotional messages and graphics or artwork. This additional feature of the package is not available with a conventional envelope, which is usually torn and discarded (even if opened at all).

A return mailer envelope 18 is provided and, in the preferred embodiment, is disposed between the promotional sheet and the back cover.

The items or sheets of the package have respective peripheral edges 19 (or other respective portions substantially adjacent to the peripheral edges) which are adhesively bound together as at 20 in FIG. 5 (and preferably intermittently along the edge) to retain the integrity of the package during mailing and handling. If the front and back covers are formed of separate sheets or cards, then the adhesive may also be applied along the left-hand side edge of the package.

A suitable indexing means, preferably constituting progressively recessed index tabs 21, are provided on the package. Preferably, but not necessarily, the index tabs are located conveniently at the lower right-hand corner of the package. By holding the package with the left hand and selecting the desired tab with the thumb of the right hand, the package may be "popped" open easily and conveniently against the retention of the adhesive means, the latter binding the package together on its peripheral edges (or its equivalent). Moreover, the front and back covers of the package are integrally joined together, so that the package has a side edge or "spine" 22, as shown more clearly in FIG. 5. The spine may also be formed of separate sheets laminated together (rather than folded) and the contents of the package may be inserted therebetween, if desired. The spine 22 is substantially opposite to the index tabs; and with this arrangement, the package may be opened and read like a book as shown more clearly in FIGS. 2 and 3.

Not only is the desired integrity of the package maintained during mailing, of further significance is that the desired order and sequence of perusing the package is maintained. This gives the advertiser the very desirable option of having the consumer (the addressee) read the advertiser's message in its order of importance or desired sequence. This is another advantage of the present invention, which cannot be facilitated by conventional delivery envelopes whose contents are dumped out and either thrown away, mixed up, or lost.

Figure 6:
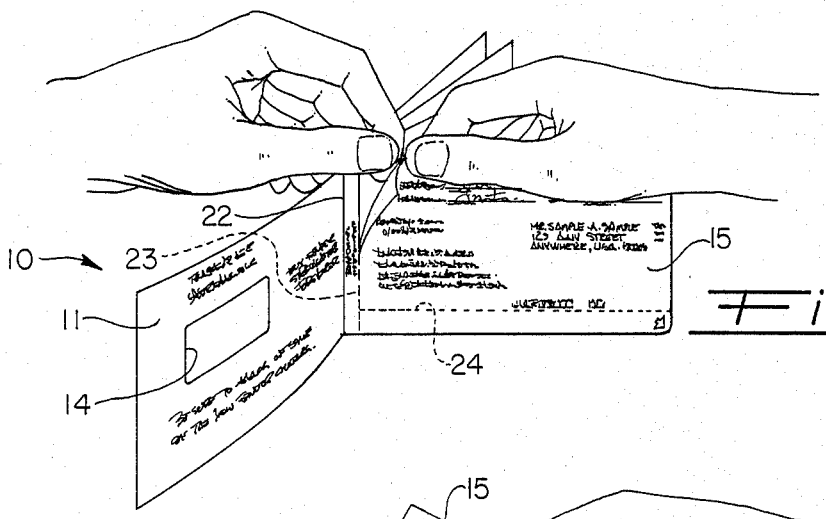
FIG. 6 is a still further perspective view, showing the manner in which the perforated acceptance form may be torn away from the package.
Figure 7:
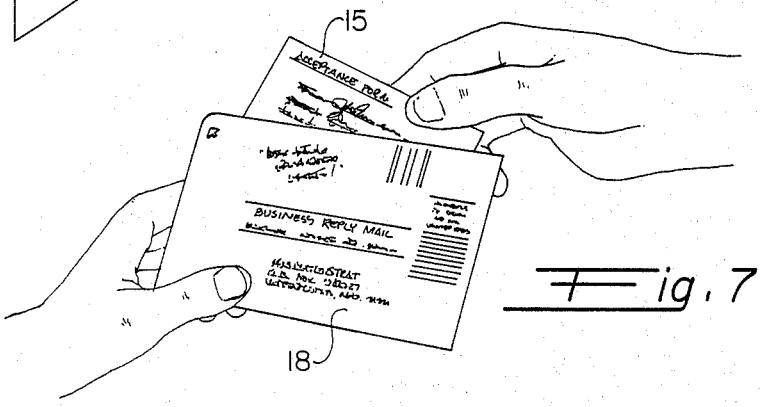
FIG. 7 is yet a further perspective view, showing the manner in which the acceptance form (after separation from the package and signature by the addressee) may be slipped easily into the return mailer envelope without folding the acceptance form.
Figure 8:
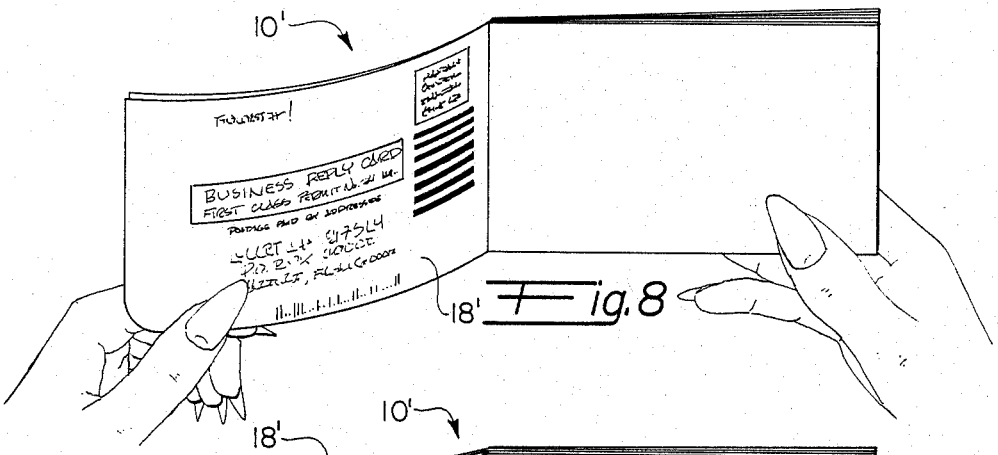
FIG. 8 is a perspective view of a first alternate embodiment in which a business reply card is on the left and a fold-out promotional insert sheet is to the right thereof.
Figure 9:
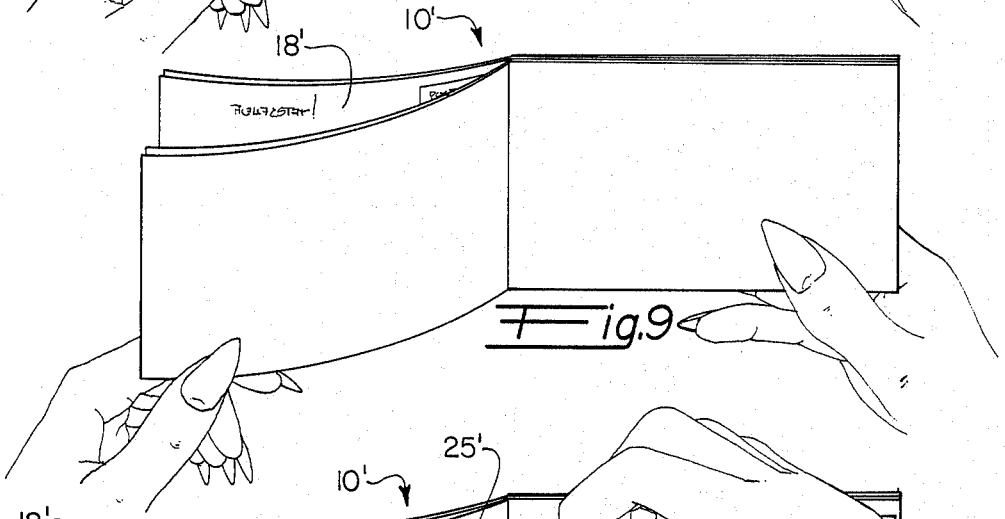
FIG. 9 is a further perspective view, corresponding substantially to FIG. 8, but showing the fold-out promotional insert sheet being partially folded to the left after being "popped" away from the package.

The acceptance form is perforated, preferably by mutually-perpendicular perforations 23 and 24, respectively, so that the acceptance form may be easily torn away from the package as shown more clearly in FIG. 6. The acceptance form has outer dimensions (length and width) which are smaller than the inside dimensions of the return mailer envelope, such that the acceptance form may be slipped easily into the envelope (as shown more clearly in FIG. 7) without folding the acceptance form. In lieu of perforations, the acceptance form may be suitably scored or folded to facilitate convenient removal from the package.

Moreover, the acceptance form 15 is made from a relatively-thin paper stock which is thinner than the front or back covers, as illustrated in FIG. 5. Not only is this less expensive, but "scannable" paper may be used. As a result, the acceptance form may be scanned by a high-speed optical reader (employed by the advertiser) without jamming the reader or distorting the card, and this is an important consideration for high-volume advertisers employing such automated equipment.

The front and back covers, however, preferably are made from heavier relatively-stiff paper stock, much like a lightweight cardboard, so that the overall package has a good "feel" or heft to promote a quality image.

Figure 10:
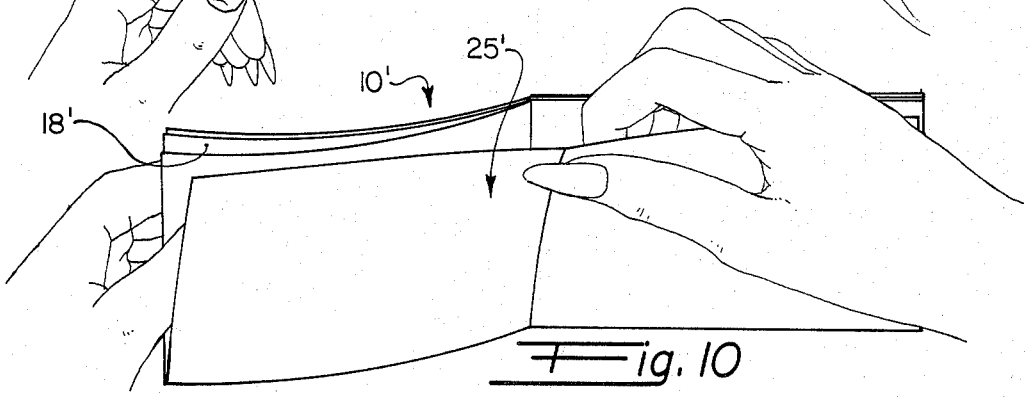
FIG. 10 is a still further perspective view, showing the fold-out promotional insert sheet completely folded to the left, and further showing the top of the sheet being partially folded down away from the package.
Figure 11:
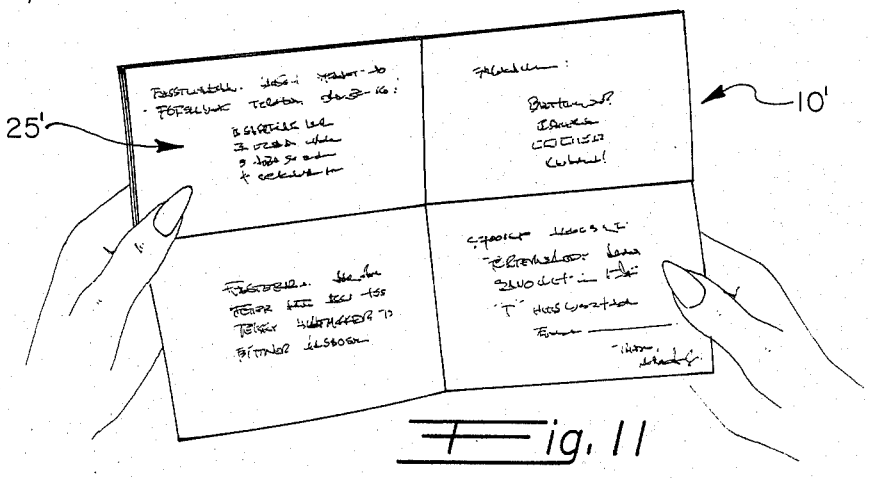
FIG. 11 is a yet still further perspective view, corresponding substantially to FIG. 10, but showing the fold-out sheet completely folded out to enable its promotional message to be read by the recipient.

With reference to FIGS. 8–11, the direct-mail advertising package 10' includes a business reply envelope 18' and also includes an acceptance form (not shown). A double fold-out promotional insert 25 is further included in the package, such that the promotional insert may be grasped as shown in FIGS. 10 and 11 and folded out for quick and convenient review by the recipient. This allows a large, attractive promotional message to be placed on a folded-out sheet which is approximately four times the size (length and width) of the mailing package itself.

Figure 12:
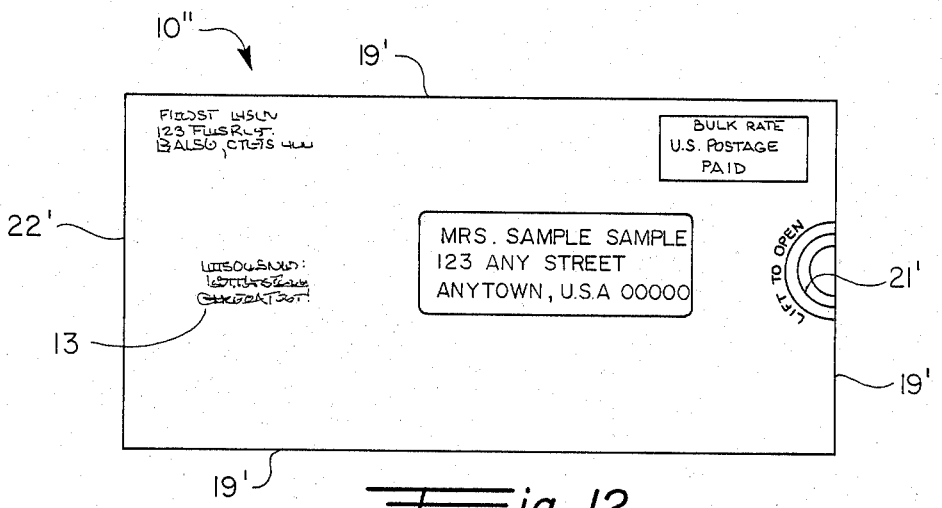
FIG. 12 is a top plan view of a second alternate embodiment, corresponding to a portion of FIG. 1, but showing how the recessed index tabs may be disposed along the right-hand peripheral edge of the package.
Figure 13:
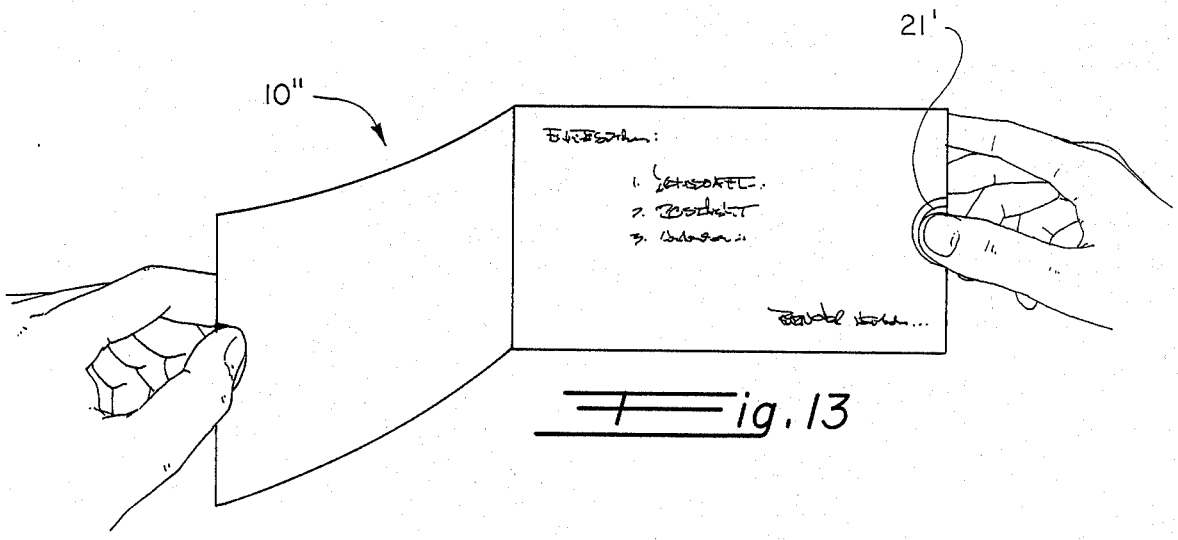
FIG. 13 is a further perspective view, showing how the embodiment of FIG. 12 is opened up by the recipient of the mailing package.

With reference to FIGS. 12 and 13, there is illustrated a mailing package 10'' having recessed indexing tabs 21' located along the side 19' which is opposite to the spine 22 and preferably at the midpoint thereof. However, the tabs 22' could be located anywhere along edge 19' and, indeed, anywhere along the top or bottom parallel edges (if desired).

Thus the present invention significantly improves the quality of the package and its delivery system, and a conventional standard envelope is not necessary to maintain the integrity and confidentiality of the delivery system.

Accordingly, it will be appreciated by those skilled in the art that the direct-mail advertising package of the present invention fulfills the objectives herein and constitutes a significant contribution to the art, one that substantially enhances the return realized by respective advertisers in the multi-billion dollar direct-mail business.

Obviously, many modifications may be made without departing from the basic spirit of the present invention. For example, sheets may be added to (or deleted from) the direct-mail advertising package, if desired. Accordingly, it will be appreciated by those skilled in the art that within the scope of the appended claims, the invention may be practiced other than has been specifically described herein.

What is claimed is:

1. A direct-mail advertising package comprising a plurality of sheets having respective peripheral portions, adhesive means for binding together at least some of the sheets substantially at their peripheral portions, thereby maintaining the integrity of the package during mailing, the plurality of sheets including a front cover, a back cover and an acceptance form, a return mailer envelope disposed between the front and back covers, the front cover bearing a display, the acceptance form bearing an addressee thereon, the package having an edge provided with a recessed indexing means, such that the package may be "popped" open to facilitate a manual separation of at least some of the sheets and a selection of the return mailer envelope against the retention of the adhesive means, the acceptance form being perforated for tearing the acceptance form away from the package, and the acceptance form upon removal from the package having outer dimensions which are less than the corresponding inner dimensions of the return mailer envelope, such that the acceptance form may be received within the envelope without folding the acceptance form.

2. The package of claim 1, wherein the front and back covers are integrally formed and are joined together to form a spine opposite to the indexing means.

3. The package of claim 1, wherein the acceptance form has mutually-perpendicular respective perforations thereon.

4. The package of claim 1, wherein the acceptance form is made from a relatively-thin paper stock, whereby the acceptance form may be passed through an optical reader without jamming the reader or distorting the card.

5. The package of claim 1, wherein the acceptance form is disposed directly beneath the front cover, and wherein the front cover has a window formed therein, whereby the addressee on the acceptance form is visible through the window.

6. A direct-mail advertising package comprising a plurality of sheets having respective peripheral portions, adhesive means for binding together at least some of the sheets substantially at their peripheral portions, thereby maintaining the integrity of the package during mailing, the plurality of sheets including a front cover, a back cover and an acceptance form, the front and back covers being made from a relatively-stiff stock and being integrally joined together to form a spine along one edge of the package, the acceptance form being disposed directly beneath the front cover and bearing an addressee thereon, the acceptance form having mutually-perpendicular respective perforations thereon, the acceptance form being made from a relatively-thin stock, whereby the acceptance form may be passed through an optical reader without jamming the reader or distorting the card, a return mailer envelope disposed between the front and back covers, the package having an edge provided with a recessed indexing means substantially opposite to the spine, whereby the package may be "popped" open to facilitate a manual separation of at least some of the sheets and a selection of the return mailer envelope against the retention of the adhesive means, the perforations on the acceptance form facilitating tearing the acceptance form away from the package, and the acceptance form upon removal from the package having outer dimensions which are less than the corresponding inner dimensions of the return mailer envelope, such that the acceptance form may be received within the envelope without folding the acceptance form.

7. The package of claim 6, wherein the front cover has a window formed therein, whereby the addressee on the acceptance form is visible through the window.

8. The package of claim 6, wherein the indexing means comprise recessed indexing tabs on a lower right-hand corner of the package.

9. A direct-mail advertising package comprising a front cover and a back cover integrally joined together to form a spine along a side edge of the package, a return mailer envelope and an acceptance form disposed between the front and back covers, adhesive means for binding at least the front and back covers together to thereby maintain the integrity of the package during mailing, and recessed indexing means substantially opposite to the spine, whereby the package may be "popped" open against the adhesive means to facilitate a selection of the return-mailer envelope and acceptance form.

10. The package of claim 9, wherein the acceptance form has mutually-perpendicular perforations formed thereon, such that the acceptance form may be torn away from the package, and such that when removed the acceptance form has outer dimensions which are less than the corresponding inner dimensions of the return-mailer envelope, whereby the acceptance form may be received within the envelope without folding the acceptance form, and wherein the acceptance form is made from a relatively-thin paper stock, whereby the acceptance form may be passed through an optical reader without jamming the reader or distorting the card.

11. The package of claim 9, further including a double fold-out promotional sheet disposed between the front and back covers.

12. A direct-mail advertising package comprising a front cover and a back cover integrally joined together to form a spine along a side edge of the package having three outer peripheral edges thereon, a double fold-out promotional sheet disposed between the front and back covers, adhesive means for binding at least the front and back covers together substantially at the peripheral portions thereof to thereby maintain the integrity of the package during mailing, and recessed indexing means on one of the three peripheral edges of the package, whereby the package may be "popped" open against the adhesive means to facilitate a selection and opening up of the double fold-out promotional sheet.

* * * * *